US008628438B1

(12) United States Patent
Cooper

(10) Patent No.: US 8,628,438 B1
(45) **Date of Patent: *Jan. 14, 2014**

(54) MULTI-BLADED EXPANDABLE BROADHEAD

(71) Applicant: Gary L. Cooper, Jonesboro, AR (US)

(72) Inventor: Gary L. Cooper, Jonesboro, AR (US)

( * ) Notice: Subject to any disclaimer, the term of this patent is extended or adjusted under 35 U.S.C. 154(b) by 51 days.

This patent is subject to a terminal disclaimer.

(21) Appl. No.: 13/625,450

(22) Filed: Sep. 24, 2012

Related U.S. Application Data

(63) Continuation of application No. 12/961,306, filed on Dec. 6, 2010, now Pat. No. 8,272,979.

(60) Provisional application No. 61/266,585, filed on Dec. 4, 2009.

(51) Int. Cl.
*F42B 6/08* (2006.01)

(52) U.S. Cl.
USPC ..... 473/583

(58) Field of Classification Search
USPC ..... 473/583, 584
See application file for complete search history.

(56) References Cited

U.S. PATENT DOCUMENTS 2,820,634 A 1/1958 Vance
3,578,328 A * 5/1971 Rickey ..... 473/583
5,078,407 A 1/1992 Carlston et al.
5,178,398 A * 1/1993 Eddy ..... 473/583
5,286,035 A 2/1994 Ward
5,458,341 A 10/1995 Forrest et al.
5,564,713 A 10/1996 Mizek et al.
5,803,845 A * 9/1998 Anderson ..... 473/583
5,879,252 A 3/1999 Johnson
6,015,357 A * 1/2000 Rizza ..... 473/583
6,517,454 B2 2/2003 Barrie et al.
6,910,979 B2 6/2005 Barrie et al.
7,377,869 B2 5/2008 Wohlfeil et al.
D583,897 S 12/2008 Ward

* cited by examiner

*Primary Examiner* — John Ricci
(74) *Attorney, Agent, or Firm* — Polster, Lieder, Woodruff & Lucchesi, L.C.

(57) ABSTRACT

An aerodynamic multi-bladed expandable broadhead with rearward mounted overlapping blades with greater in-flight blade angles along with substantially perpendicular blade edges relative to the arrowhead body. Position of blades in flight guarantees they will always make a lethal cut on contact with an animal even before expansion. Greater in-flight blade angle means less force to open blades on hide guaranteeing expansion, and minimal rotation of blades to the penetration position results in a maximum entry cut and greater penetration. By expanding the distance between the blade edge and pivot a stronger blocky blade is produced. Geometry dictates during entry when blades hit bone on angle shots arrow direction will favorably remain in its intended lethal path to an animal.

14 Claims, 4 Drawing Sheets

MULTI-BLADED EXPANDABLE BROADHEAD

CROSS-REFERENCE TO RELATED APPLICATIONS

This application is a continuation-in-part of U.S. application Ser. No. 12/961,306, filed Dec. 6, 2010, now U.S. Pat. No. 8,272,979, issued Sep. 25, 2012, which claims the benefit of U.S. Provisional application Ser. No. 61/266,585, filed Dec. 4, 2009. Both these applications are incorporated herein by reference.

BACKGROUND OF THE INVENTION

The present invention relates to the field of archery, more specifically to hunting arrowheads called broadheads. There are two types of broadheads: fixed where there are no moving parts and a constant cutting diameter, and mechanical where there are moving parts. Mechanical broadheads have less surface area in flight for great accuracy, and an expanding diameter when contacting the animal for greater cutting diameter than when passing the bow riser and in flight.

A common problem of mechanical broadheads with the tips of the sharpened blade edges near the tip of the ferrule or head body is that the force it takes to open the blades reduces penetration, such as in Mizek et al., U.S. Pat. No. 5,564,713. Also, when a bone is hit upon entry the blade tip may act in a "pole vaulting" manner and push the arrow out from its intended path to a different angle and cause a non-fatal hit.

Another disadvantage is a small entry wound, such as is produced by the head described in Johnson, U.S. Pat. No. 5,879,252 where the blade tips enter the animal without having a fully expanded diameter. With a small entry hole, blood will not exit well for tracking. Also long slender blades have proven fragile when contacting bone.

Barrie et al., U.S. Pat. No. 6,910,979 attempts to improve mechanical performance by having the blades slide rearward, eliminating the pole vaulting effect of the blade tips. However, as in some other designs, blade securement is a problem, as the blade tips are lightly secured inserted inside an O-ring, such that removing the arrow from the quiver or the shock of launch may cause the head to open prematurely during flight, planing it off course. Further, the head is barbed in both its open and, more importantly, closed positions.

Forrest et al., U.S. Pat. No. 5,458,341, uses a trip blade to open the main cutting blade after that blade has penetrated the animal. This again produces a small entry wound. Also if the trip blade hits bone, it prevents the main blades from opening so the arrowhead loses penetration energy and is deflected.

Other patents on similar systems with similar problems include Vance, U.S. Pat. No. 2,820,634; Carlston, et al., U.S. Pat. No. 5,078,407; Ward, U.S. Pat. No. 5,286,035; Barrie et al., U.S. Pat. No. 6,517,454; Barrie et al., U.S. Pat. No. 6,910,979; Wohlfeil et al., U.S. Pat. No. 7,377,869; and Ward, U.S. Pat. No. D583,897.

All of the foregoing patents are hereby incorporated by reference.

SUMMARY OF THE INVENTION

The present invention is a mechanical broadhead whose geometry eliminates known problems with current broadheads.

The inventor has observed that the farther forward the blade tips are positioned and the more parallel the blade edge angle and blade tip is to the ferrule, the greater the undesirable "pole vaulting" effect of pushing the ferrule tip off course upon entry when the blade tips contact bone, resulting in an unintended arrow path away from the aimed path to the vital organs for a quick kill. By positioning the blades with their major cutting edges in a more perpendicular position to the ferrule axis during flight, upon contact with bone the arrow continues on a favorable path to the vitals.

Also, a more rearward position of the blade cutting edges allows the ferrule tip to contact the animal as the blade tips do on quartering shots, thereby directing the head to continue along the intended path. Greater in-flight angle of the blade cutting edges relative to the ferrule results in a shorter degree of pivoting rotation to a completely open position; this produces a maximum entry cut, and also gives greater leverage upon contact with an animal. This reduces the energy expended overcoming the resistance of the mechanism containing the blades in flight and reduces the force needed to pivot the blades to their fully rotated impact or penetration position, thus reliably insuring the blades will always open and producing improved penetration.

Since the blades are positioned at a point below where the ferrule tip is inserted in the quiver they are not subject to being opened accidentally or dulling blades.

In the preferred embodiments a simple elastic band may be positioned around the base of the blades near the pivot point, and they are reliably secured so as not to prematurely open by being bumped or by the force of the shot. The elastic band is positioned to constrain the blades until contact with an animal, then the band is either broken or pushed back as blades open allowing them to engage their penetration position, and after the shot the blades may pivot forward where they are not deemed illegally barbed.

In preferred embodiments, it is also possible for the band to remain positioned around the blades such that after the shot, the blades are forced forward by the band constrainment to a position where the blades are in a non-barbed position. Some regulations do not allow mechanical broadheads to be used as they may fail to open and produce a killing cut. However, in the broadhead of the present invention the novel blade geometry and position means that a substantial portion of the blade edges will make a lethal cut when the head contacts an animal, even without pivoting open, so the head is 100% guaranteed to reliably make a deadly cut as much as a fixed blade no matter what.

Since the blades substantially overlap each other inside the ferrule and in some embodiments outside the ferrule, surface area is reduced for greater aerodynamics and truer flight.

The blades are also of a blocky triangular geometry, resulting in greater strength as opposed to long slender blades which may break. In illustrative embodiments, the blade comprises a main cutting edge and a pivot, the distance from the pivot to the nearest point on the cutting edge being at least 50% as long as the distance from the point to a distal end of the blade. The absolute distance between the pivot and the nearest point on the cutting edge is preferably at least 0.25". A generally triangular web between the cutting edge and the pivot further strengthens the blade and insures that the blade can be pulled out without any barb structure behind the cutting edge.

In embodiments of the invention, a mechanical broadhead comprises an arrowhead body having a central longitudinal axis, the body having a rearward end that attaches to an arrow shaft and a forward pointed end, the body having at least one slot; and at least two overlapping blades housed in the slot during flight, the blades being rotatably mounted in the slot to rotate rearwardly during impact with a target or game, each blade having a main cutting edge oriented at an angle of 90°±40° relative to the axis in flight. The orientation of the cutting edge is determined by drawing a line extending through the distal end of the edge (the end farthest from the central axis) and through the intersection of the edge with the axis, and measuring the angle between this line and the axis. In illustrative preferred embodiments, the cutting edge is straight, so the line and the edge are the same. The broadhead preferably comprises a pivot entirely behind the main cutting edge in flight.

The blades' main cutting edges are preferably oriented 90°±15° relative to the long axis in flight and protrude a substantial distance, the distal ends of the cutting edges in flight preferably being spaced apart at least half their spacing in their fully open impact position. In some embodiments, each blade has cutting edge ends extending out both sides of the slot in flight.

Mechanical stops are preferably provided to set a maximum forward rotation of the blades in their closed flight position and to set a maximum rearward rotation in their open penetration position. Illustratively, each blade has a pivot base, rearward of the pivot, with a first portion which contacts the arrowhead body limiting the rotation of the blade in a closed flight position and a second portion which contacts the arrowhead body limiting the rotation of the blade in an open impact position.

In preferred embodiments of the invention, a line from the distal end of the cutting edge to the pivot point when the blade is in its open impact position forms an angle of 90°±20° with the central longitudinal axis. This orientation of the blade's main cutting edge insures that the spread of the blade's cutting edge in the fully open position is at least 95% of its maximum spread, in some embodiments at least 98% or more. Therefore, less energy is expended than in many previous designs in which the blades are momentarily opened farther than their final spread.

In illustrative embodiments, the distance between distal ends of the main cutting edges in closed flight position is between 1.0" and 1.5". This is a greater spread than is commonly found in mechanical broadheads. In these embodiments, the distance between the distal ends in open impact position is between 1.1 and 2.0 times the distance in closed flight position, and in some preferred embodiments the distance is between 1.1 and 1.5 times the distance in closed flight position. In these preferred embodiments, the maximum spread of the blades is also 1.1 to 1.5 times the closed spread between the distal ends of the cutting edges. Although this is far less than conventional mechanical broadheads, it has been found that the mechanical broadhead of the present invention has excellent flight characteristics and great effectiveness as a hunting head.

In preferred embodiments, the main cutting edge forms an angle of 45°±15° with the axis when the blade is in its open stop position.

In illustrative embodiments, at least a portion of the main cutting edge of each blade is exposed, and is spaced at least 0.25" behind the point, the angle of a line through the blade tip and the pivot is 45°±15° in relation to the axis and the angle of the cutting edge is 90°±40° relative to the axis in flight in relation to the axis.

Also in illustrative embodiments, at least one blade is housed in the slot during flight, the blade being rotatably mounted by a pivot in the slot to rotate rearwardly from a closed flight position to an open impact penetration position during impact with a target or game, the blade having a main cutting edge, a line through the distal end of the main cutting edge and the pivot forming an angle with the axis of 45°±15 in the closed flight position and forming an angle with the axis of 90°±15° in the open penetration position.

It will be noted that if the slot or slots do not intersect the geometric axis of the arrowhead body, lines determined by points on the blade are technically skew lines with respect to the geometric axis. Therefore, when angles with the axis are specified, they are conventionally measured with respect to a line defined by the intersection of the plane of the slot with a plane containing the axis and perpendicular to the plane of the slot.

DESCRIPTION OF THE PREFERRED EMBODIMENTS

Figure 1:
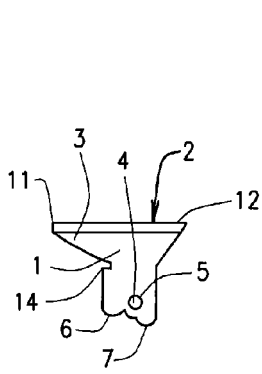
FIG. 1 is a top plan view of one embodiment of novel arrowhead blade for use in a mechanical broadhead of the present invention.

Referring to FIG. 1, arrowhead blade 1 of the present invention includes a forwardly-facing sharpened main cutting edge 2, a generally triangular web portion 3 behind the edge 2, a pivot hole 5, rotation-limiting base portions 6 and 7, and a notch 14. Because the sharpened cutting edge 2 of this embodiment is a straight line, the closest point 4 on the edge to the pivot hole 5 is the intersection with the cutting edge of a line perpendicular to it through the hole 5. The main cutting edge 2 has distal end 11 in relation to pivot hole 5 and proximal end 12 in relation to pivot hole 5. The cutting edge 2 of blade 1 is about 1.2" long, about 0.7" from the point 4 to the distal end 11 and about 0.5" from the point 4 to proximal end 12. The distance from the center of hole 5 to the point 4 is about 0.7".

Figure 1A:
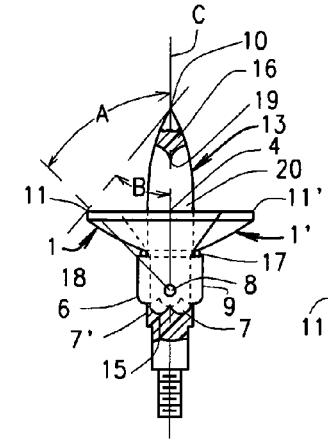
FIG. 1A is a plan view, partially cut away, of an expanding arrowhead of the present invention in flight position, containing dual pivoting blades of FIG. 1.

FIG. 1A depicts an arrowhead of the present invention in a closed flight position. The arrowhead includes a body or ferrule 13 having a threaded arrow-engaging rear ferrule end 9 and a forward ferrule tip 10 in the form of a sharp point. The arrowhead has a central longitudinal axis C. A longitudinally extending interior slot 20 is cut laterally through the ferrule 13. The slot 20 has a rear terminus 15 and forward terminus 16, cut by cutting wheels to have central cusps 18 and 19 respectively.

The blade 1 is pivotably mounted in the slot 20 by pivot screw 8 extending through pivot hole 5. Rotation-limiting base portion 7 is in contact with the right side of rear terminus 15, limiting clockwise rotation.

An identical blade 1', turned over so as to be a mirror image of blade 1, is pivotably mounted on pivot screw 8 in longitudinally extending interior slot 20 of ferrule 3 under blade 1 as viewed in FIG. 1A. Rotation-limiting base portion 7' of the blade 1' is in contact with the left side of rear terminus 15, limiting counterclockwise rotation.

Blade 1' also has proximal edge end 12' in relation to pivot screw 8, and distal edge end 11' in relation to pivot screw 8. Pivoting blades 1 and 2 are secured in ferrule 3 with screw 8. Elastic band 17, in the form of an o-ring, is positioned around ferrule 3 and the notches 14 and 14' of blades 1 and 1' securing them in a closed in-flight position. In this position, the distance between distal end 11 and distal end 11' is about 1.5".

As illustrated in FIG. 1A, in its in-flight configuration, the forward main cutting edge 2 of the blade 1 (measured along a line from its distal end 11 to its intersection with the longitudinal axis C) forms a 90° angle with the longitudinal axis C of the body 13. A line through the distal end 11 and pivot 8 forms an angle A with the axis C of about 47°. Likewise, a line through the distal end 11 and point 10 forms an angle B with the axis C of about 40°. The same angles apply to blade 1'.

Figure 1B:
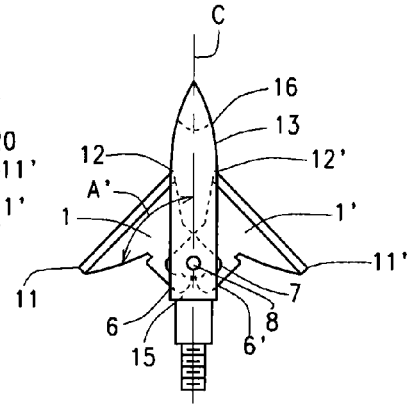
FIG. 1B is a plan view of the arrowhead of FIG. 1A in its fully expanded penetrating position.

FIG. 1B depicts the arrowhead in an expanded penetration position. Rotation limiting base portion 6 has rotated so it is in contact with rear terminus 15, limiting counterclockwise rotation, stopping blade 1 in its desired penetration position. Rotation limiting base portion 6' of blade 1' has rotated so it is in contact with rear terminus 15, limiting clockwise rotation and stopping blade 1' in its desired penetration position.

As shown in FIG. 1B, in its extended, stop-limited impact position, the main cutting edge 2 forms an angle of about 45° with the axis C, as measured from the distal end 11 to a projected intersection with the axis C. A line through the distal end 11 and the center of pivot 8 makes an angle A' of about a 92° with the axis C. These angles indicate that substantially the entire length of the cutting edge 2 is extended beyond the ferrule 13 and that the spread between the distal ends 11 and 11' is 99.9% of the maximum spread attained during rearward rotation of the blades 1 and 1'.

FIGS. 2-2B and 3-3B illustrate modifications differing from the first embodiment only in the geometry, hence orientation, of the blades.

Figure 2:
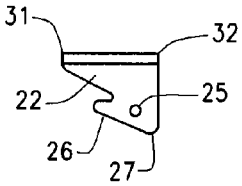
FIG. 2 is a plan view of a second embodiment of arrowhead blade of the present invention.

Referring to FIG. 2 arrowhead blade 22 has pivot hole 25 and rotation limiting base portions 26 and 27. Blade 22 also has proximal edge end 31 in relation to pivot hole 25 and distal edge end 32 in relation to pivot hole 25.

Figure 2A:
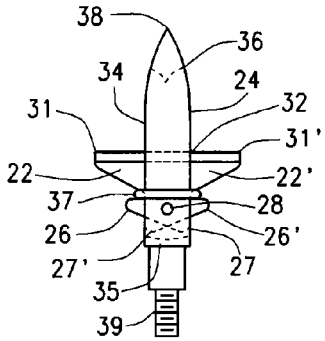
FIG. 2A is a plan view of a second embodiment of expanding arrowhead in flight position containing dual pivoting blades of FIG. 2.

Referring now to FIG. 2A depicting the arrowhead in a flight position, blade 22 mounted in a longitudinally extending interior slot of ferrule 24, as defined by rear terminus 35 and forward terminus 36, has pivot screw 28 and rotation limiting base portions 26 and 27. Rotation limiting base portion 27 is in contact with rear terminus 35, limiting clockwise rotation. Blade 22 also has proximal edge end 32 in relation to pivot screw 28 and distal edge end 31 in relation to pivot screw 28. Blade 22' mounted in longitudinally extending interior slot of ferrule 24 as defined by rear terminus 35 and forward terminus 36 has pivot screw 28 and rotation limiting base portions 26' and 27'. Rotation limiting base portion 27' is In contact with rear terminus 35, limiting counterclockwise rotation. Blade 22' also has proximal edge end 32' in relation to pivot screw 28, and distal edge end 31' in relation to pivot screw 28. Pivoting blades 22 and 22' are secured in ferrule 24 with screw 28. Elastic band 37 is positioned around ferrule 24 and blades 22 and 22' securing them in an in-flight position. Ferrule 24 has arrow engaging ferrule end 39 and ferrule tip 38.

Figure 2B:
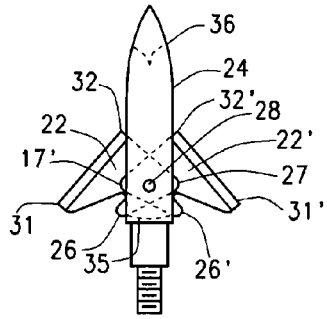
FIG. 2B is a plan view of the arrowhead of FIG. 2A in its fully expanded penetrating position.

FIG. 2B depicts the arrowhead in an expanded penetration position. Rotation limiting base portion 26 has rotated so it is in contact with rear terminus 35, limiting counter clockwise rotation, stopping blade 22 in its desired penetration position. Edge end 32 and edge end 31 project out the same side of ferrule 24. Blade 22' has rotated rearwardly in the same way. Rotation limiting base portion 26' has rotated so it is in contact with rear terminus 35, limiting clockwise rotation, stopping blade 22' in its desired penetration position. Edge end 34 and edge end 33 project out the same side of ferrule 24.

Figure 3:
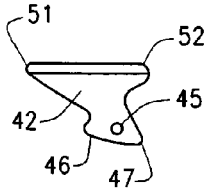
FIG. 3 is a plan view of a third embodiment of arrowhead blade of the present invention.

Referring to FIG. 3 arrowhead blade 42 has pivot hole 45 and rotation limiting base portions 46 and 47. Blade 42 also has proximal edge end 52 in relation to pivot hole 45 and distal edge end 51 in relation to pivot hole 45.

Figure 3A:
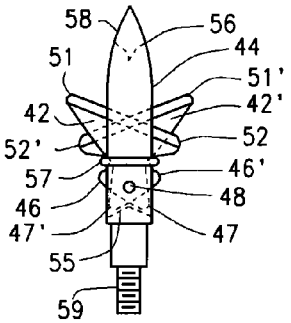
FIG. 3A is a plan view of a third embodiment of expanding arrowhead in flight position containing dual pivoting blades of FIG. 3.

Referring now to FIG. 3A depicting the arrowhead in a flight position, blade 42 is mounted in a longitudinally extending interior slot of ferrule 44 as defined by rear terminus 55 and forward terminus 56 by pivot screw 48. Rotation limiting base portion 47 is in contact with rear terminus 55, limiting clockwise rotation. Blade 42 also has proximal edge end 52 in relation to pivot screw 48 and distal edge end 51 in relation to pivot screw 48.

Blade 42' is also mounted in the longitudinally extending interior slot of ferrule 44 as defined by rear terminus 55 and forward terminus 56 by pivot screw 48. Blade 42' has rotation limiting base portions 46' and 47'. Rotation limiting base portion 47' is in contact with rear terminus 55, limiting counter clockwise rotation.

Elastic band 57 is positioned around ferrule 44 and blades 42 and 42' securing them in an in-flight position. Ferrule 44 has arrow engaging ferrule end 59 and ferrule tip 58. The forward main cutting edge of each blade 42 and 42' forms an angle of about 70° with the central axis of the ferrule 44 in its flight position. This geometry reduces the spread between distal ends 51 and 51' in the flight position.

Figure 3B:
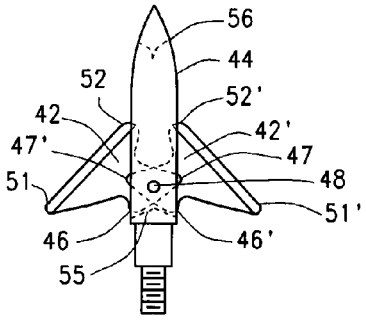
FIG. 3B is a plan view of the arrowhead of FIG. 3A in its fully expanded penetrating position.

FIG. 3B depicts the arrowhead in an expanded penetration position. Rotation-limiting base portion 46 has rotated so it is in contact with rear terminus 55, limiting counter clockwise rotation, stopping blade 42 in its desired penetration position. Blade 42' also has rotated rearwardly until rotation-limiting base portion 46' has rotated so it is in contact with rear terminus 55, limiting clockwise rotation, stopping blade 42' in its desired penetration position. Each blade 42 and 42' has rotated until a line through the distal ends 51 and 51' respectively and the pivot 48 each form an angle of about 95° with the central longitudinal axis C. Therefore, in the final, stopped, open impact position the spread between distal ends 51 and 51' is about 99.6% of the maximum spread attained while the blades rotate rearwardly from their flight position. The geometry of this embodiment makes the spread between distal ends 51 and 51' in the impact position about 1.8 times the spread in the flight position.

Figure 4:
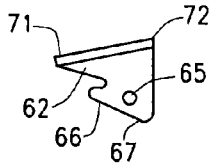
FIG. 4 is a plan view of a fourth embodiment of arrowhead blade of the present invention.

Referring to FIG. 4, arrowhead blade 62 has pivot hole 65 and rotation limiting base portions 66 and 67. Blade 62 also has proximal edge end 72 in relation to pivot hole 65 and distal edge end 71 in relation to pivot hole 65.

Figure 4A:
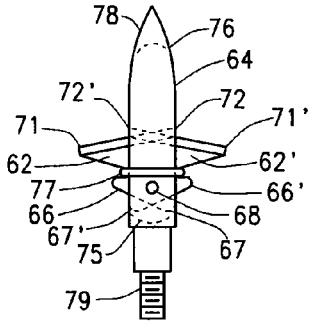
FIG. 4A is a plan view of a fourth embodiment of expanding arrowhead in flight position containing dual pivoting blades of FIG. 4.

FIG. 4A depicts the arrowhead in a flight position, with blade 62 mounted in a longitudinally extending interior slot of ferrule 64 as defined by rear terminus 75 and forward terminus 76. In this embodiment, the ferrule 64 is molded or cast with the rear terminus 75 and forward terminus 76 formed during molding or casting. The ferrule 64 has pivot screw 68. Rotation limiting base portion 67 is in contact with rear terminus 75, limiting clockwise rotation. Blade 62 also has proximal edge end 72 in relation to pivot screw 68 and distal edge end 71 in relation to pivot screw 68.

Blade 62' is mounted in the longitudinally extending interior slot of ferrule 64 as defined by rear terminus 75 and forward terminus 76 by pivot screw 68. Blade 62' has rotation limiting base portions 66' and 67'. Rotation limiting base portion 67' is in contact with rear terminus 75, limiting counterclockwise rotation. Pivoting blades 62 and 62' are secured in ferrule 64 with screw 68.

Elastic band 77 is positioned around ferrule 64 and blades 62 and 62' securing them in an in-flight position. Ferrule 64 has arrow engaging ferrule end 79 and ferrule tip 78. The forward main cutting edge of each blade 62 and 62' forms an angle of about 100° with the central axis of the ferrule 64 in its flight position. This geometry reduces the spread between distal ends 71 and 71' in the flight position.

Figure 4B:
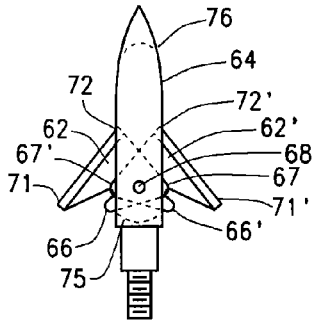
FIG. 4B is a plan view of the arrowhead of FIG. 4A in its fully expanded penetrating position.

FIG. 4B depicts the arrowhead in an expanded penetration position. Rotation-limiting base portion 66 has rotated so it is in contact with rear terminus 75, limiting counter clockwise rotation, stopping blade 62 in its desired penetration position. Blade 62' also has rotated rearwardly until rotation-limiting base portion 66' has rotated so it is in contact with rear terminus 75, limiting clockwise rotation, stopping blade 62' in its desired penetration position. Each blade 62 and 62' has rotated until a line through the distal ends 51 and 51' respectively and the pivot 48 each form an angle of about 100° with the central longitudinal axis C. Therefore, in the final, stopped, open impact position the spread between distal ends 51 and 51' is about 98.5% of the maximum spread attained while the blades rotate rearwardly from their flight position. The geometry of this embodiment makes the spread between distal ends 71 and 71' in the impact position about 1.1 times the spread in the flight position.

Figure 5:
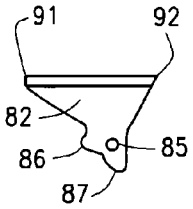
FIG. 5 is a plan view of a fifth embodiment of arrowhead blade of the present invention.

Referring now to FIG. 5 a blade 82 is substituted for the blade 1 of FIGS. 1-1B. The blade 82 has pivot hole 85 and rotation limiting base portions 86 and 87. Blade 82 also has proximal edge end 92 in relation to pivot hole 85 and distal edge end 91 in relation to pivot hole 95.

Figure 5A:
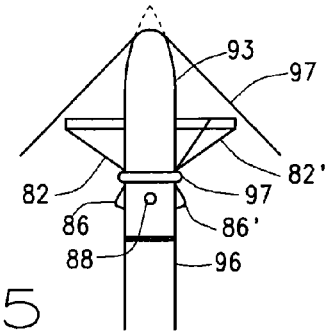
FIG. 5A is a plan view of a fifth embodiment of expanding arrowhead containing dual pivoting blades of FIG. 5, in flight position and attached to an arrow contacting stretched animal hide.

FIG. 5A depicts the arrowhead in a flight position, with blades 82 and 82' mounted in a longitudinally extending interior slot of ferrule 84, which may be identical with ferrule 13 of the first embodiment. Rotation-limiting base portion 87 limits clockwise rotation of blade 82, and base portion 87' limits counterclockwise rotation of blade 82'. Pivoting blades 82 and 82' are secured in ferrule 84 with screw 88.

Elastic band 97 is positioned around ferrule 84 and blades 82 and 82' securing them in an in-flight position. Ferrule 84 has arrow engaging ferrule end which is threaded into arrow 96; Ferrule 84 also has a forward ferrule tip 98. FIG. 5A shows arrowhead tip 98 penetrating animal hide 97 in a broadside position. It will be seen that the blade tips do not touch the hide 97, despite its being severely distorted by the penetration of arrow tip 98.

Figure 5B:
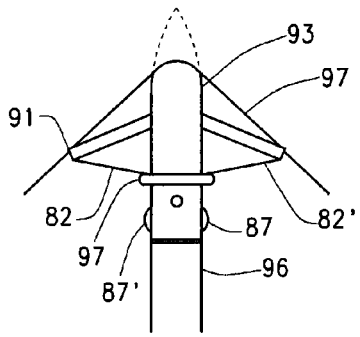
FIG. 5B is a top plan view of the arrowhead of FIG. 2A as the arrowhead further penetrates the animal hide and the blades are partially pivoted down by the animal hide.

Referring now to FIG. 5B, expanding arrowhead 93 is shown further penetrating animal hide 97 with arrowhead tip 98. Tips of blades 82 and 82' have contacted animal hide 97 and pivoted down initiating the opening of expanding arrowhead to a penetration position.

Figure 6:
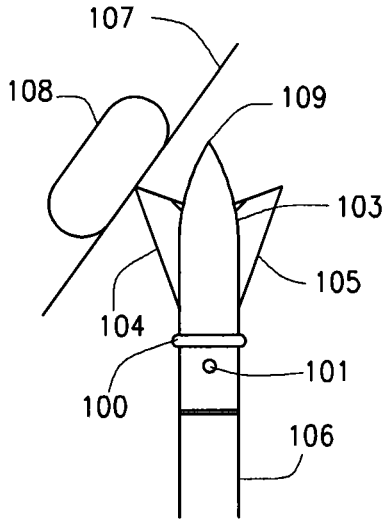
FIG. 6 PRIOR ART
FIG. 6 is a top plan view of a prior art arrowhead attached to an arrow, depicting the blade tip contacting animal hide and rib at a quartering angle.

Referring now to FIG. 6, a prior art expandable arrowhead 103 has tip 109 and is attached to arrow 106. Overlapping blades 104 and 105 are mounted in expanding arrowhead 103 by screw 101 and constrained by elastic band 100 in an in-flight position. Tip of blade 104 is shown penetrating animal hide 107 and contacting animal rib 108 at a quartering angle.

Figure 6A:
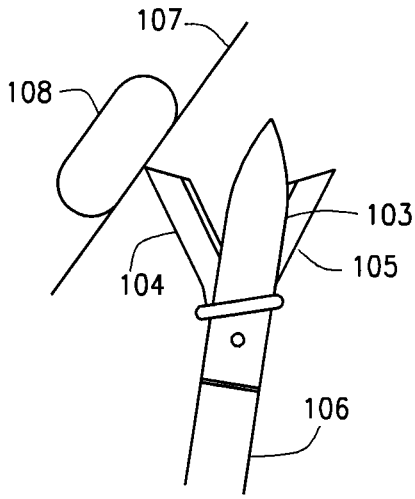
FIG. 6A PRIOR ART
FIG. 6A is a top plan view of the prior art arrowhead and arrow of FIG. 6, depicting further progress of the arrowhead and its blade tip contacting animal hide and rib at a quartering angle.

Referring now to FIG. 6A as expanding arrowhead 103 progresses further, the tip of blade 104 striking rib 108 as expanding arrowhead 103 progresses forward has initiated opening of blade 104. This action has caused expanding arrowhead 103 to be pushed (pole vaulted) at an unfavorable angle away from its intended lethal course.

Figure 7:
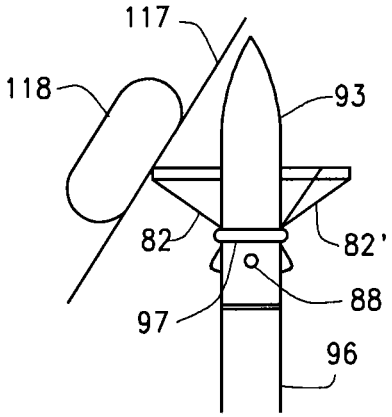
FIG. 7 is a top plan view, corresponding to FIG. 6, of an expanding arrowhead of the present invention attached to an arrow, depicting its blade tip contacting animal hide and rib at a quartering angle.

Referring now to FIG. 7, the expandable arrowhead 93 of FIG. 5A in accordance with the present invention is shown striking an animal rib in the same manner as the foregoing prior art example. Tip of blade 82 is shown penetrating animal hide 117 and contacting animal rib 118 at a quartering angle.

Figure 7A:
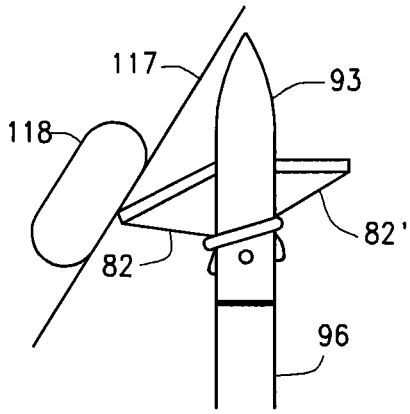
FIG. 7A is a top plan view of the expanding arrowhead and arrow of FIG. 7 depicting further progress of the arrowhead and its blade tip contacting animal hide and rib at a quartering angle.

Referring now to FIG. 7A, as the expanding arrowhead progresses further, the tip of blade 82, striking rib 118 as the expanding arrowhead progresses forward has initiated opening of blade 82. The direction of the mechanical broadhead, however, continues forward in a favorable lethal angle to the animal's vitals for a quick, efficient kill. The function of this form of broadhead should be obvious from the sequential motion FIGS. 5 and 5A, and 7 and 7A, depicting blade tips contacting an animal so that blades are rotated downward to an open position. Blades may be mounted substantially perpendicular at various in-flight positions, as long as a greater length of blade edge extends from the side of the ferrule rotating down than the side of the ferrule rotating up. Greater leverage from contacting an animal with the greater length blade edge insures the blade will rotate down to its fully open penetration position.

Figure 8:
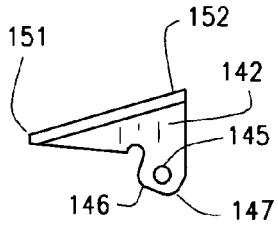
FIG. 8 is a plan view of a fifth embodiment of arrowhead blade of the present invention.
Figure 8A:
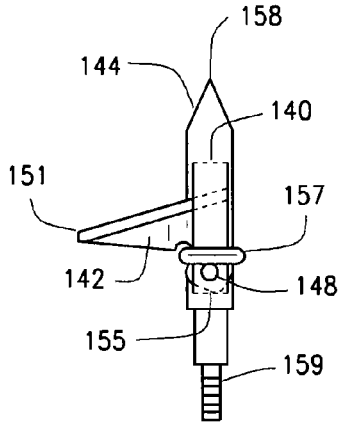
FIG. 8A is a plan view of a fifth embodiment of expanding arrowhead in flight position containing three blades of FIG. 8.
Figure 8B:
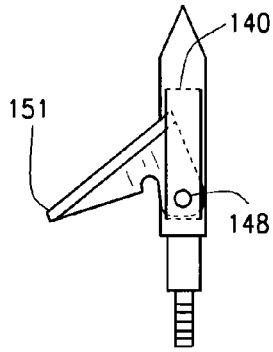
FIG. 8B is a plan view of the arrowhead of FIG. 8A in its fully expanded penetrating position.
Figure 8C:
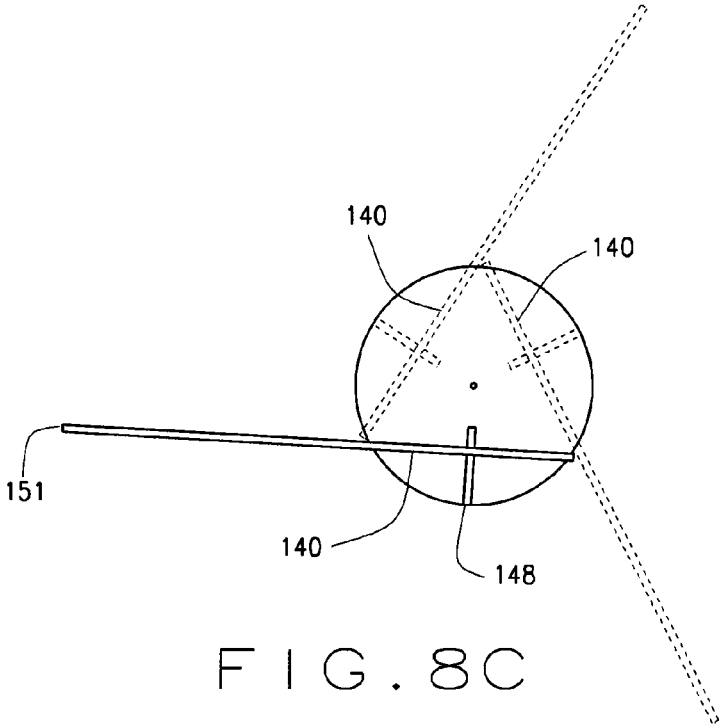
FIG. 8C is a cross-sectional view showing the relationship of the three slots in FIGS. 8A and 8B.

Referring now to FIGS. 8-8C, an embodiment having three slots and three blades is illustrated. As shown in FIG. 8, arrowhead blade 142 has pivot hole 145 and rotation limiting base portions 146 and 1477. Blade 142 also has proximal edge end 152 in relation to pivot hole 65 and distal edge end 151 in relation to pivot hole 145.

FIG. 8A depicts the arrowhead in a flight position, with blade 142 mounted in one of three longitudinally extending interior slots 140 in ferrule 144. For clarity, the other two blades are omitted from FIGS. 8A and 8B and are shown in phantom lines in FIG. 8C. The slots are milled into the aluminum ferrule 144.

The ferrule 144 has arrow engaging ferrule end 159 and ferrule tip 158. The ferrule 144 has pivot screw 148 extending through pivot hole 145 of the blade 142. Elastic band 157 is positioned around ferrule 144 and blades 142, securing them in an in-flight position. Rotation-limiting base portion 147 is in contact with the rear terminus 155 of the slot 140, limiting clockwise rotation when the blades 142 are in their closed, in-flight position.

The forward main cutting edge of each blade 142 forms an angle of about 110° with the central axis of the ferrule 144 in its flight position. This geometry reduces the distance from distal ends 151 to the axis of the ferrule, hence the spread between distal ends 151.

FIG. 8B depicts the arrowhead in an expanded penetration position. Rotation-limiting base portion 146 has rotated so it is in contact with rear terminus 155, limiting counter clockwise rotation, stopping blade 142 in its desired penetration position. Blade 142 has rotated until a line through the distal end 151 and the pivot 148 forms an angle of about 90° with the central longitudinal axis. Therefore, in the final, stopped, open impact position the spread between distal ends 151 is about 100% of the maximum spread attained while the blades rotate rearwardly from their flight position. The geometry of this embodiment makes the spread between distal ends 71 and 71' in the impact position about 1.1 times the spread in the flight position.

Numerous variations in the construction of the broadhead of this invention will occur to those skilled in the art in the light of the foregoing disclosure. The external shapes or dimensions of the blades and the angles of the sharp edges can be varied. The arrowhead body (ferrule) and the tip can be made various shapes and can be made unitary or in parts. The body may be made of any appropriate material, including for example metal, such as aluminum, carbon steel, stainless steel, tungsten, or metal alloys, or hard plastic, such as composites. Numerous blades may be mounted. Fixed blades may be mounted in the tip or body in addition to moveable blades. The blades also may be made of any appropriate material, including for example those mentioned for the body. The terminal portion of the ferrule may also include numerous fittings besides the threaded shank. The elastic band may be either an o-ring as illustrated or a flat band. Various mechanisms may be used to secure the blades besides elastic band arrangements, such as blade-to-blade or blade-to-ferrule friction, spring arrangements, shear pins, magnetic attraction, etc. The blades may have ends that are blunt, recessed or pointed. The blades edges may be straight, curved, or irregular, such as serrated. Blade tips may extend forward from the ferrule, be parallel with the ferrule, or extend backward from the ferrule. These variations are merely illustrative.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A mechanical broadhead comprising:

a. an arrowhead body having a central longitudinal axis, the body having a rearward end that attaches to an arrow shaft and a forward pointed end, the body having at least one slot; and b. at least one blade housed in said slot during flight, the blade being rotatably mounted by a pivot in the slot to rotate rearwardly from a closed flight position to an open impact penetration position during impact with a target or game, said blade having a generally straight main cutting edge oriented at an angle of 90°±40° relative to said axis in flight.

2. The broadhead of claim 1 comprising a pivot entirely behind the main cutting edge of said blade in flight, the distance from the pivot to the nearest point on the cutting edge of said blade being at least 50% as long as the distance from said point to a distal end of said blade.

3. The broadhead of claim 2 wherein said distance from the pivot to the nearest point on the cutting edge of each blade is at least 0.25".

4. The broadhead of claim 1 wherein said blade main cutting edge is oriented 90°±15° relative to said axis in flight.

5. The broadhead of claim 1 wherein said slot is open at both ends, and wherein said blade has cutting edge ends extending out both sides of said slot in flight.

6. The broadhead of claim 1 wherein said blade has a pivot base with a first portion which contacts the arrowhead body limiting the rotation of the blade in a closed flight position and a second portion which contacts the arrowhead body limiting the rotation of the blade in an open impact position.

7. The broadhead of claim 1 wherein a resilient band is constrained around the body and the blade and positions the blade in a closed position in flight.

8. The broadhead of claim 1 wherein the body has a plurality of slots, at least one blade being mounted in each said slot.

9. The broadhead of claim 8 wherein the slots define non-parallel, non-intersecting chords.

10. The broadhead of claim 9 wherein the broadhead comprises exactly three slots.

11. A mechanical broadhead comprising:

a. an arrowhead body having a central longitudinal axis, the body having a rearward end that attaches to an arrow shaft and a forward pointed end, the body having at least one slot; and b. a blade housed in said slot during flight, the blade being rotatably mounted in the slot to rotate around a pivot point rearwardly from a closed flight position to an open stop position during impact with a target or game, the open stop position being determined by stop structure on the body and on each said blade, wherein said blade has a main cutting edge with a distal end, a line from the distal end to the pivot point when the blade is in its open stop position forming an angle of 90°±20° with said axis, and wherein the main cutting edge forms an angle of 45°±15° with said axis when the blade is in its open stop position.

12. A mechanical broadhead comprising:

a. an arrowhead body having a central longitudinal axis, the body having a rearward end that attaches to an arrow shaft and a forward pointed end, the body having at least one slot; and b. at least one blade housed in said slot during flight, the blade being rotatably mounted in the slot to rotate around a pivot point rearwardly from a closed flight position to an open stop position during impact with a target or game, the open stop position being determined by stop structure on the body and on each said blade, each said blade having a main cutting edge with a distal end, a line from the distal end to the pivot point when the blade is in its open stop position forming an angle of 90°±20° with said axis, wherein the distance between said distal end and said axis in said open impact position is between 1.1 and 1.5 times the distance between said distal end and said axis in closed flight position.

13. The broadhead of claim 12 wherein the distance between said distal end and said axis in open impact position is at least 98% of the maximum distance between said distal end and said axis as the blade rotates rearwardly.

14. The broadhead of claim 12 wherein said pivot point is entirely behind the main cutting edge of said blade in flight.

* * * * *